US011753853B2

(12) United States Patent
Guevara Arreola et al.

(10) Patent No.: US 11,753,853 B2
(45) Date of Patent: Sep. 12, 2023

(54) VEHICLE DOOR LATCH

(71) Applicant: Inteva Products, LLC, Troy, MI (US)

(72) Inventors: Francisco Javier Guevara Arreola, Chih (MX); Carlos Issac Tostado Bocanegra, Chih (MX); Oscar Omar Estrada Lazcano, Mexico City (MX); Ari Yussel Mino Ramirez, Chih (MX); Victor Daniel Varela Antillon, Chih (MX); Jesus Osvaldo Alvarez Morales, Chih (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 763 days.

(21) Appl. No.: 16/026,727

(22) Filed: Jul. 3, 2018

(65) Prior Publication Data

US 2020/0011094 A1 Jan. 9, 2020

(51) Int. Cl.

| | |
|---|---|
| ***E05B 77/34*** | (2014.01) |
| ***E05B 77/36*** | (2014.01) |
| ***E05B 85/02*** | (2014.01) |
| ***E05B 77/26*** | (2014.01) |
| ***E05B 15/16*** | (2006.01) |

(52) U.S. Cl.

CPC ..... *E05B 77/34* (2013.01); *E05B 15/1635* (2013.01); *E05B 77/26* (2013.01); *E05B 77/36* (2013.01); *E05B 85/02* (2013.01)

(58) Field of Classification Search

CPC ..... E05B 77/34; E05B 85/02; E05B 77/26; E05B 77/38; E05B 77/40; E05B 77/36; E05B 15/1635; E05B 2015/0486; Y10T 292/1082; Y10T 292/1047; Y10S 292/23

See application file for complete search history.

(56) References Cited

U.S. PATENT DOCUMENTS

| | | | | |
|---|---|---|---|---|
| 6,168,215 | B1 * | 1/2001 | Kodama | E05B 81/06 292/201 |
| 7,140,070 | B2 | 11/2006 | Yuta et al. | |
| 8,141,916 | B2 * | 3/2012 | Tomaszewski | E05B 81/18 292/201 |

(Continued)

FOREIGN PATENT DOCUMENTS

| | | | |
|---|---|---|---|
| CN | 1496897 | A | 5/2004 |
| CN | 103080450 | A | 5/2013 |

(Continued)

OTHER PUBLICATIONS

CN Office Action for CN Application No. 2018110839482; dated Jul. 23, 2020.

(Continued)

*Primary Examiner* — Kristina R Fulton
*Assistant Examiner* — Noah Horowitz
(74) *Attorney, Agent, or Firm* — CANTOR COLBURN LLP

(57) ABSTRACT

A vehicle latch assembly includes a plurality of levers for transferring actuation forces to open and close the vehicle latch assembly, at least one of the plurality of levers formed of at least one polymer, wherein the plurality of levers includes a child lock engage lever. Also included is an actuator housing assembly including a water deflector enclosing a connection between an actuator housing and a cover, the vehicle latch assembly reducing sound, reducing release effort, and reducing water intrusion.

17 Claims, 7 Drawing Sheets

(56) References Cited

U.S. PATENT DOCUMENTS

| | | | | |
|---|---|---|---|---|
| 9,447,604 | B2 * | 9/2016 | Witte | E05B 7/00 |
| 10,094,149 | B2 | 10/2018 | Mittelbach | |
| 2013/0152645 | A1 | 6/2013 | Bendel et al. | |
| 2018/0038137 | A1 * | 2/2018 | Damboiu | E05B 81/42 |
| 2018/0245378 | A1 * | 8/2018 | Nagaoka | E05B 83/36 |

FOREIGN PATENT DOCUMENTS

| | | | | |
|---|---|---|---|---|
| CN | 202990636 | U | 6/2013 | |
| CN | 104685144 | A | 6/2015 | |
| DE | 202011003361 | U1 * | 7/2012 | B60J 10/86 |
| DE | 102017125549 | A1 * | 5/2018 | E05B 77/265 |
| EP | 0940241 | A2 | 9/1999 | |
| EP | 1207254 | A1 * | 5/2002 | E05B 17/04 |
| WO | WO-0188314 | A2 * | 11/2001 | E05B 77/30 |
| WO | WO-2021223791 | A * | 11/2021 | |

OTHER PUBLICATIONS

English Translation to CN Office Action for CN Application No. 2018110839482; dated Jul. 23, 2020.
Search Report for CN Application No. 2018110839482.
English Translation to Second CN Office Action for CN Application No. 2018110839482; dated Apr. 27, 2021.
Search Report for CN Application No. 2018110839482; dated Apr. 22, 2021.
Second CN Office Action for CN Application No. 2018110839482; dated Apr. 27, 2021.
Decision of Rejection for China Application No. 201811083948.2; Application Filing Date: Sep. 17, 2018; dated Sep. 27, 2021; 19 pages, with English Translation.
Chinese Office Action for Chinese Application No. 2018110839482 dated Feb. 9, 2022.

* cited by examiner

VEHICLE DOOR LATCH

BACKGROUND

The subject matter disclosed herein relates to vehicle door latches.

Vehicle door latches must meet strength and sound requirements for various markets. The release feeling of some latches is not smooth and a user experiences undesired "bumps" during operating. Additionally, a high seal load release requirement may not be met by prior assemblies. Child security lock and unlock efforts are not precise and they decrease after high temperature exposure in some latch assemblies. Latches also must address the possibility of water intrusion. Therefore, proper sealing and/or diversion of water away from interior portions of the latch assembly must be provided.

SUMMARY

Disclosed is a vehicle latch assembly. The assembly includes a plurality of levers for transferring actuation forces to open and close the vehicle latch assembly, at least one of the plurality of levers formed of at least one polymer, wherein the plurality of levers includes a child lock engage lever. Also included is an actuator housing assembly including a water deflector enclosing a connection between an actuator housing and a cover, the vehicle latch assembly reducing sound, reducing release effort, and reducing water intrusion.

Also disclosed is a vehicle latch assembly. The assembly includes a plurality of levers for transferring actuation forces to open and close the vehicle latch assembly, at least one of the plurality of levers formed of at least one polymer, at least one of the plurality of levers include at least one reinforcement rib. The assembly also includes an actuator housing assembly including a water deflector enclosing a connection between an actuator housing and a cover. The assembly further includes a child security mechanism having a torsion spring connecting the child security mechanism to an inner release mechanism.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawing in which:

Figure 1:
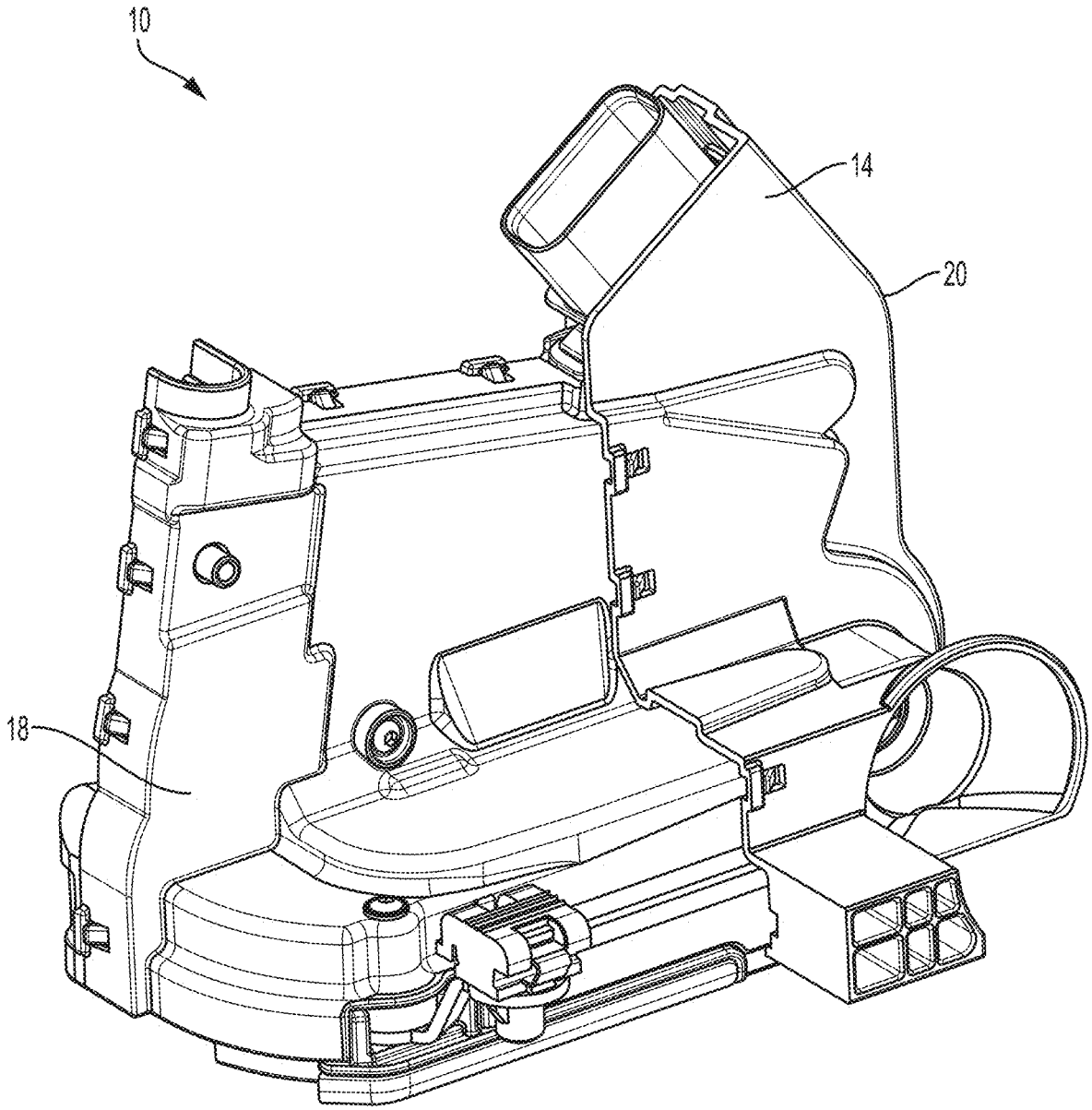
FIG. 1 is a first perspective view of a housing of a vehicle latch assembly.

The detailed description explains embodiments of the invention, together with advantages and features, by way of example with reference to the drawing.

DETAILED DESCRIPTION OF THE INVENTION

Figure 2:
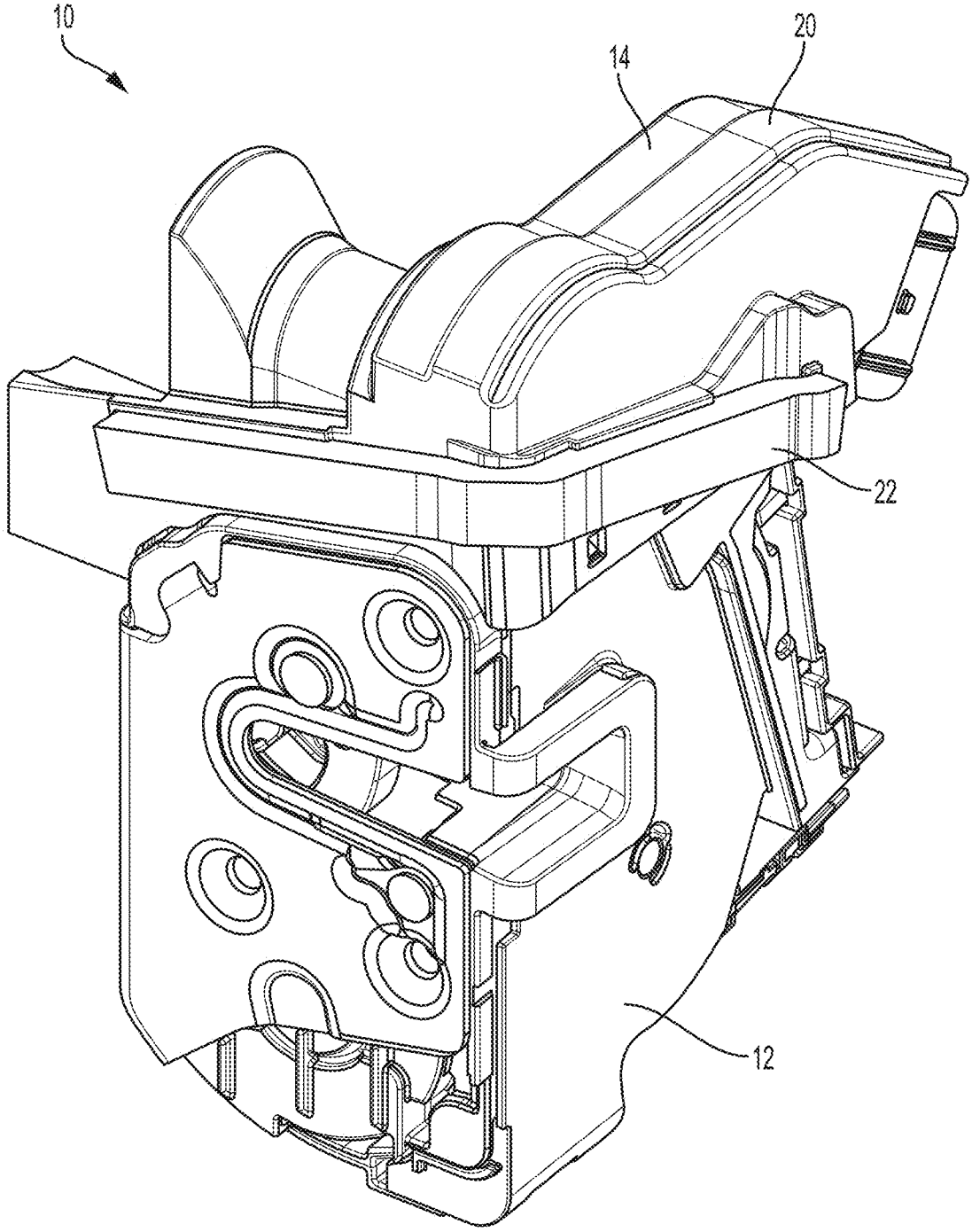
FIG. 2 is a second perspective view of the housing.

Referring to FIGS. 1 and 2, reference numeral 10 generally designates a vehicle latch assembly according to a first embodiment. The vehicle latch assembly 10 is generally designed for use on a vehicle (not illustrated) having a vehicle door with a door handle. The vehicle latch assembly 10 may be installed on the driver side door or a passenger side door in some embodiments. Additionally, it is contemplated that the vehicle latch assembly 10 may be installed in alternative locations of the vehicle, such as a vehicle door opening on the B-pillar or may be used in conjunction with a rear door of the vehicle, such as a liftgate, trunk or tailgate, for example.

The vehicle latch assembly 10 includes a housing 12 that helps protect the vehicle latch assembly 10 from damage, as well as dirt and debris. The housing 12 is mounted to the vehicle door, such as with a plurality of mechanical fasteners or welding, for example. The housing 12 includes a water deflector 14 that encloses the connection between the housing 12 and a cover 18, thereby eliminating potential moisture intrusion areas. The water deflector 14 includes one or more bends 20 to deflect moisture. A seal foam 22 is provided to maintain a constant foam compression with door sheet metal, thereby guiding moisture away from the latch interior components. The water deflector prevents water intrusion to interior regions of the vehicle latch assembly 10, which is a concern with latch assemblies, as described above.

Figure 3:
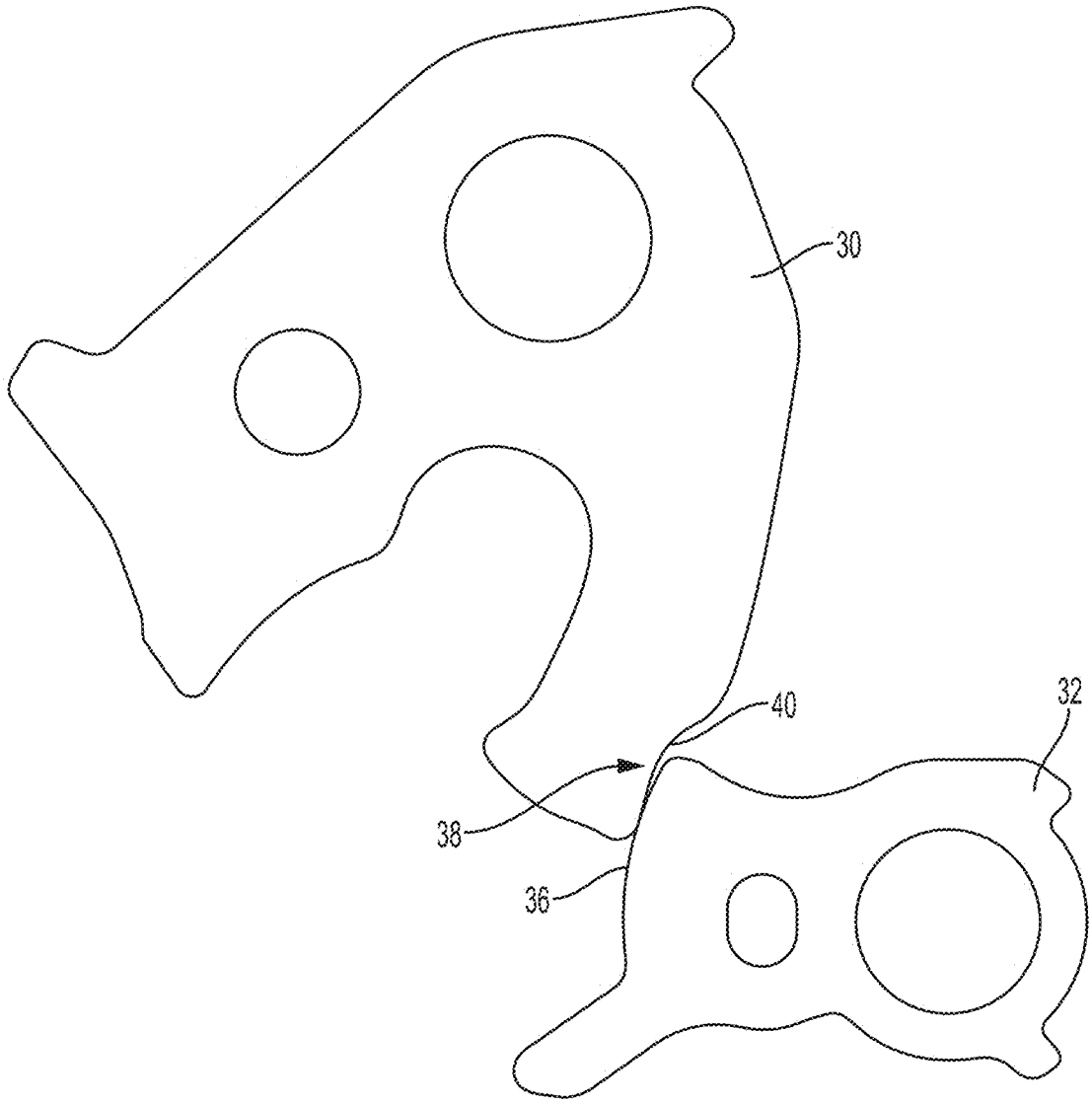
FIG. 3 is an elevational view of a claw and pawl of the vehicle latch assembly.

FIG. 3 shows interior components of the vehicle latch assembly 10. A rotatable claw 30 releasably retains a striker (not shown) to hold the door (or liftgate, trunk, tailgate, etc.) in a closed position. The claw 30 is held in the closed position by a pawl 32. The pawl 32 is actuated to disengage from the claw 30, thereby allowing the claw 30 to be released and biased toward an open position. This operation releases the striker from the claw 30 and facilitates an opening of the vehicle door. The pawl 32 is at least partially disposed within the housing 12. The pawl 32 is pivotable about an axis and rotatable between different operating positions. During various rotational positions of the pawl 32 and claw 30, the claw and pawl come into close proximity with each other, such that contact occurs. Such contact may generate an audible sound which is likely to be unpleasant to a user.

To reduce the undesirable sound attributed to claw 30 and pawl 32 contact, a pawl radius of curvature 34 at a pawl contact surface region 36 is matched to a claw radius of curvature 38 at a claw contact surface region 40. The radii of curvature may vary depending upon the application. This improves the closing and opening sound of the overall latch assembly.

Figure 4:
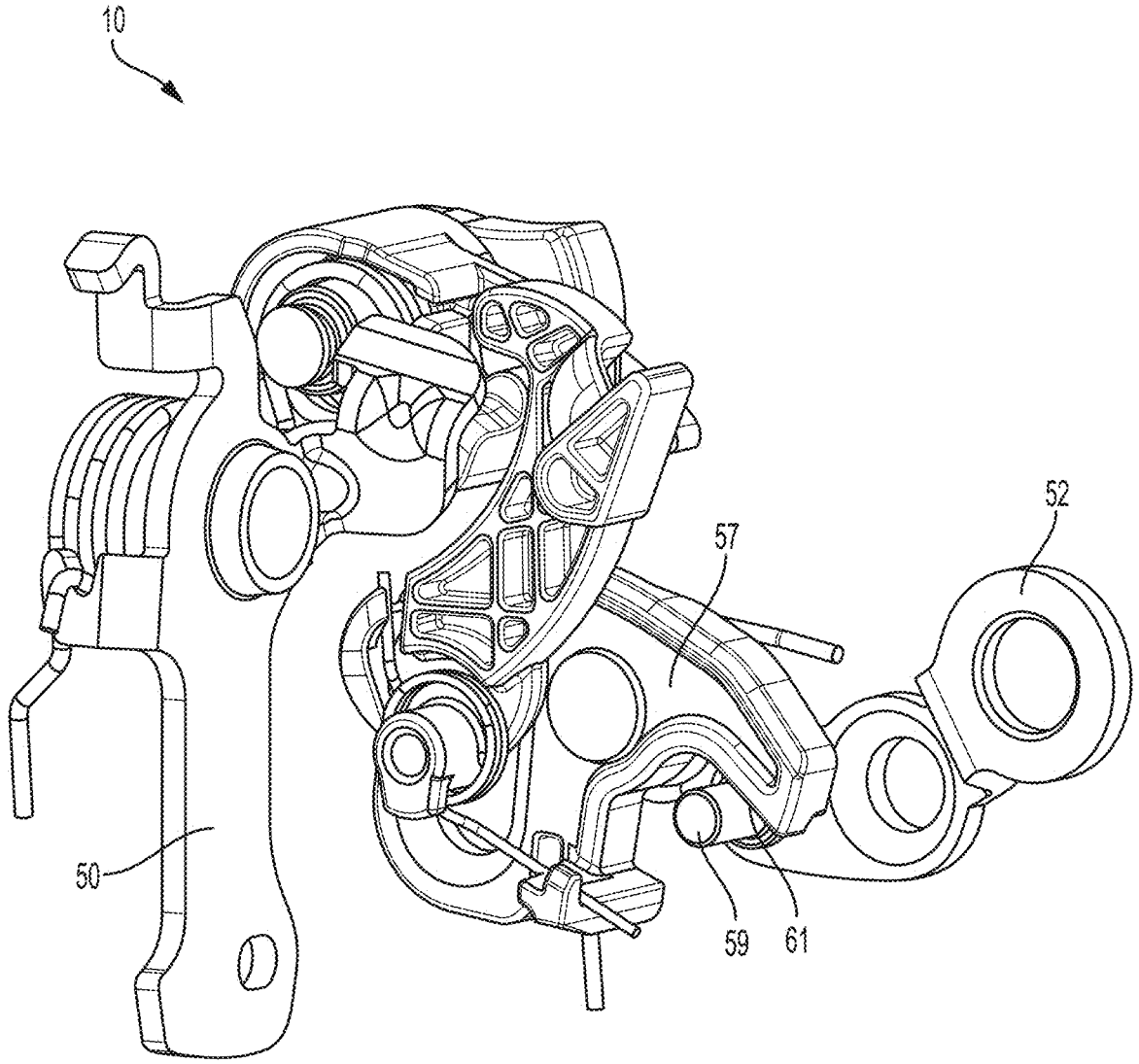
FIG. 4 is a perspective view of the vehicle latch assembly.
Figure 5:
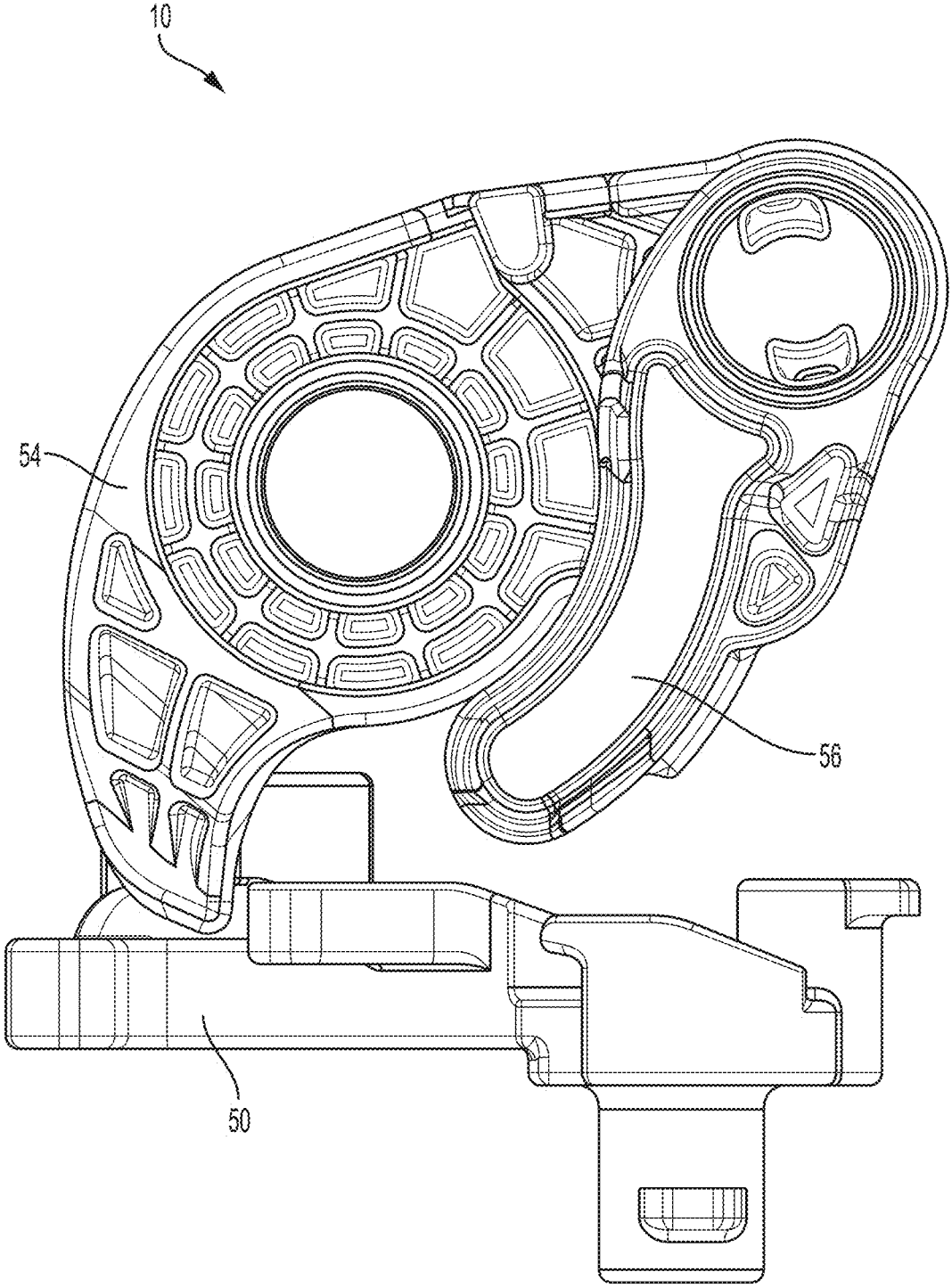
FIG. 5 is an elevational view of the vehicle latch assembly.

Referring now to FIGS. 4 and 5, the housing 12 of the latch assembly 10 is removed to illustrate other interior components of the latch assembly 10. Several components of the latch assembly 10 are formed of at least one polymer. In some embodiments, an intermittent lever 50 (FIG. 4), an outer release lever 52 (FIG. 4), an inner release lever 54 (FIG. 5), and a child lock engage lever 56 (FIG. 5) are formed as injection molded polymer parts. By forming these components of a polymer, rather than steel as traditionally done, more specific geometries are attainable and release travel accuracy are improved. Some or all of the levers include at least one rib to structurally reinforce the components.

FIG. 4 also illustrates a lever 57 configured for contact with a bolt 59. The interface surface 61 of the lever 57 includes a curved surface. The entire lever 57 or only the interface surface 61 is formed of a polymer to improve sound quality.

Figure 6:
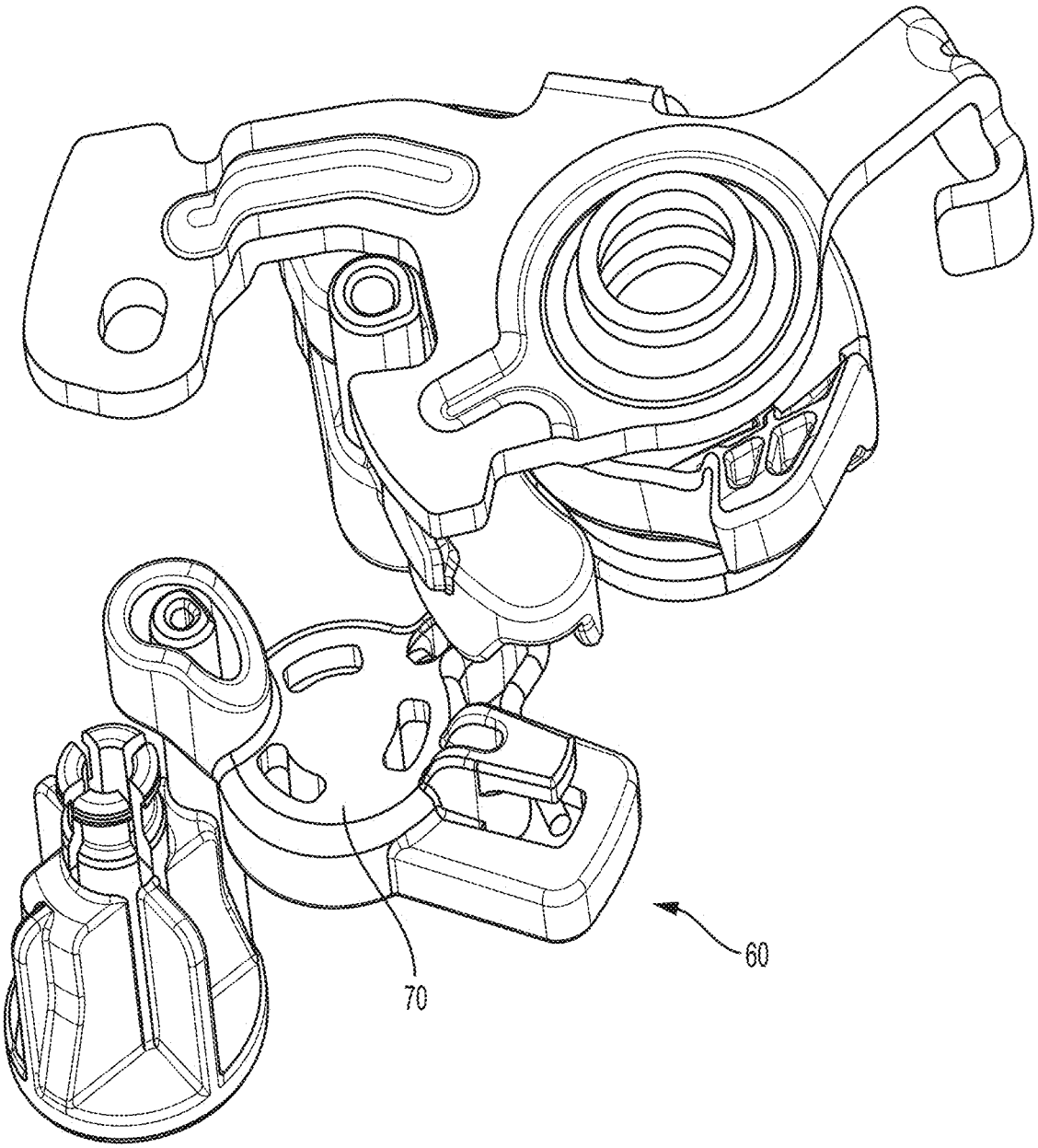
FIG. 6 is a perspective view of a child security mechanism of the vehicle latch assembly.
Figure 7:
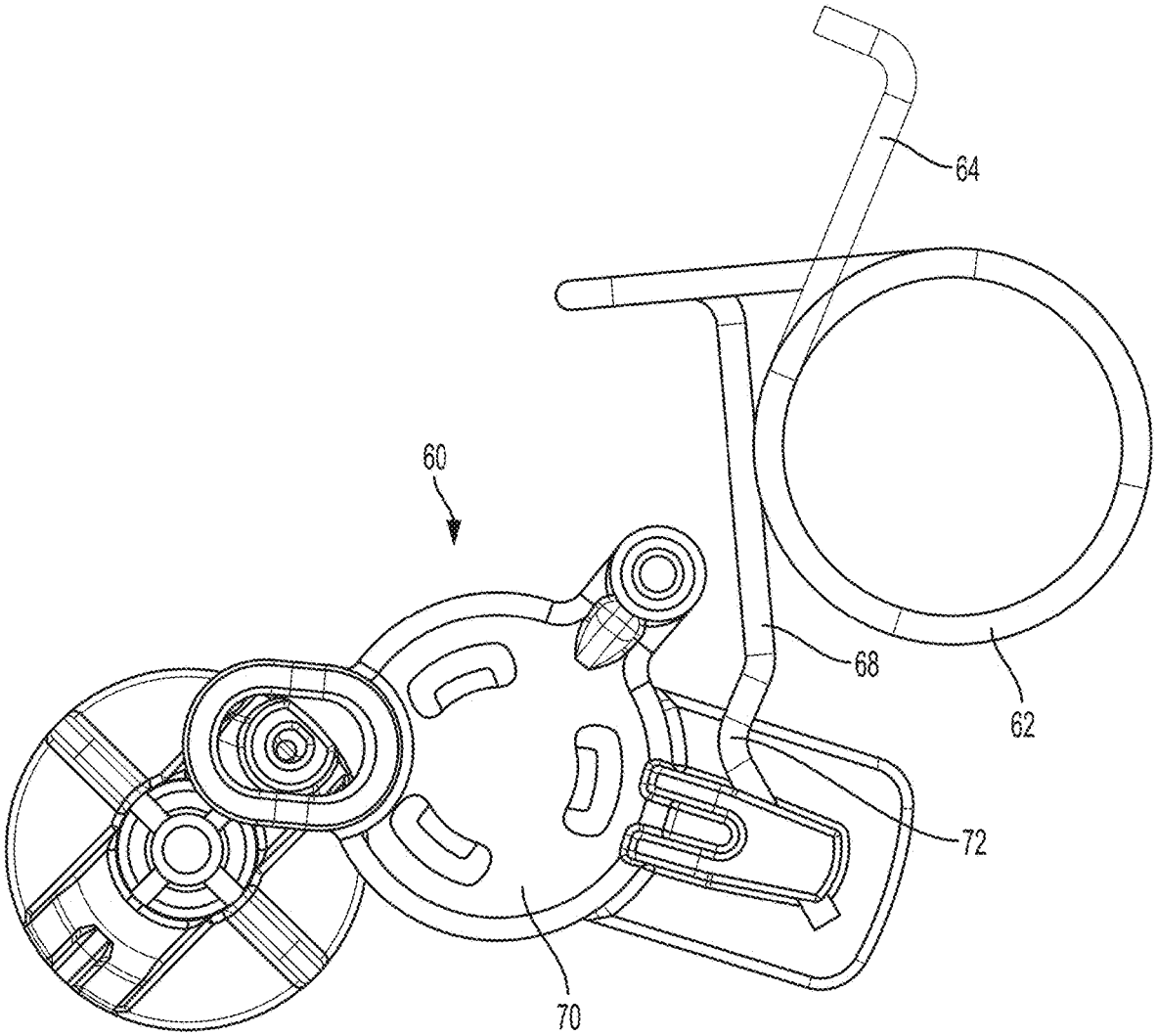
FIG. 7 is an elevational view of the child security mechanism.

Referring to FIGS. 6 and 7, a child security mechanism 60 of the latch assembly 10 is illustrated. The child security mechanism 60 includes a steel torsional spring 62 that provides precise and accurate lock and unlock efforts even after thermal exposure. The spring 62 is a common spring between two mechanisms, specifically an inner release mechanism and the child security mechanism 60. One of the spring legs 64 interacts with the inner release lever 54, providing a required effort on the inner release lever 54 and the other leg 68 interacts on the child security actuator lever 70 as a cantilever bar with a bump 72. The bump 72 on the spring leg accommodates the child lock mechanism 60 in either a locked or unlocked position.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A vehicle latch assembly comprising:

a plurality of levers for transferring actuation forces to open and close the vehicle latch assembly, at least one of the plurality of levers formed of at least one polymer, wherein the plurality of levers includes a child lock engage lever;

an actuator housing assembly including a water deflector enclosing a connection between an actuator housing and a cover, wherein the water deflector has a pair of side walls that extend over portions of the actuator housing and the cover and the pair of side walls are joined to each other by a portion of the water deflector that forms an exterior of the vehicle latch assembly, the vehicle latch assembly reducing sound, reducing release effort, and reducing water intrusion;

a child security mechanism having a torsion spring connecting the child security mechanism to an inner release mechanism, the torsion spring having a first leg and a second leg;

wherein the first leg of the torsion spring interacts with an inner release lever of the inner release mechanism and the second leg of the torsion spring interacts on a child security actuator lever of the child security mechanism as a cantilever bar with a bump which interacts with the child security mechanism in order to retain it in either a locked or unlocked position; and a seal foam mounted to an exterior surface of the water deflector.

2. The vehicle latch assembly of claim 1, wherein at least one of the plurality of levers include at least one reinforcement rib.

3. The vehicle latch assembly of claim 1, wherein the plurality of levers includes an intermittent lever.

4. The vehicle latch assembly of claim 1, wherein the plurality of levers includes an outer release lever.

5. The vehicle latch assembly of claim 1, wherein the plurality of levers includes the inner release lever.

6. The vehicle latch assembly of claim 1, wherein at least one of the plurality of levers includes a curved interface surface for contacting a bolt, the curved interface surface formed of a polymer.

7. The vehicle latch assembly of claim 1, wherein the water deflector includes at least one bend.

8. A vehicle latch assembly comprising:

a plurality of levers for transferring actuation forces to open and close the vehicle latch assembly, at least one of the plurality of levers formed of at least one polymer, at least one of the plurality of levers include at least one reinforcement rib;

an actuator housing assembly including a water deflector enclosing a connection between an actuator housing and a cover, wherein the water deflector has a pair of side walls that extend over portions of the actuator housing and the cover and the pair of side walls are joined to each other by a portion of the water deflector that forms an exterior of the vehicle latch assembly;

a seal foam mounted to an exterior surface of the water deflector; and a child security mechanism having a torsion spring connecting the child security mechanism to an inner release mechanism, the torsion spring having a pair of legs;

wherein, one of the pair of legs of the torsion spring interacts with an inner release lever of the inner release mechanism and the other one of the pair of legs of the torsion spring interacts on a child security actuator lever of the child security mechanism as a cantilever bar with a bump which interacts with the child security mechanism in order to retain it in either a locked or unlocked position.

9. The vehicle latch assembly of claim 8, wherein the water deflector includes at least one bend.

10. The vehicle latch assembly of claim 8, wherein the plurality of levers includes at least one of an intermittent lever, an outer release lever, the inner release lever, and a child lock engage lever.

11. The vehicle latch assembly of claim 10, wherein at least one of the plurality of levers includes a curved interface surface for contacting a bolt, the curved interface surface formed of a polymer.

12. The vehicle latch assembly of claim 1, wherein the bump is proximate to a distal end of the second leg and the second leg extends from a third leg that extends from the torsion spring.

13. The vehicle latch assembly of claim 12, wherein the third leg extends in a first direction and the second leg extends in a second direction, the second direction being different from the first direction.

14. The vehicle latch assembly of claim 13, wherein the first direction is generally orthogonal to the second direction.

15. The vehicle latch assembly of claim 8, wherein the bump is proximate to a distal end of the other one of the pair of legs of the torsion spring and the other one of the pair of legs of the torsion spring extends from a third leg that extends from the torsion spring.

16. The vehicle latch assembly of claim 12, wherein the third leg extends in a first direction and the second one of the pair of legs of the torsion spring extends in a second direction, the second direction being different from the first direction.

17. The vehicle latch assembly of claim 13, wherein the first direction is generally orthogonal to the second direction.

* * * * *